US006519791B2

(12) United States Patent
Randolph

(10) Patent No.: US 6,519,791 B2
(45) Date of Patent: Feb. 18, 2003

(54) STUB-OUT BAR

(75) Inventor: Scott W. Randolph, Valley Center, CA (US)

(73) Assignee: Securus, Inc., San Marcos, CA (US)

( * ) Notice: Subject to any disclaimer, the term of this patent is extended or adjusted under 35 U.S.C. 154(b) by 0 days.

(21) Appl. No.: 09/898,538

(22) Filed: Jul. 3, 2001

(65) Prior Publication Data

US 2003/0005517 A1 Jan. 9, 2003

(51) Int. Cl.[7] ..... E03C 1/042
(52) U.S. Cl. ..... 4/695; 4/696; 4/DIG. 7
(58) Field of Search ..... 4/695, 696, DIG. 7; 248/57, 56, 200.1, 68.1, 343, 906

(56) References Cited

U.S. PATENT DOCUMENTS

| | | | | |
|---|---|---|---|---|
| 1,211,182 | A | | 1/1917 | Kruse |
| 1,906,197 | A | | 4/1933 | Mangin |
| 1,982,957 | A | | 12/1934 | Knell |
| 2,023,083 | A | | 12/1935 | Knell |
| 2,773,708 | A | * | 12/1956 | Beyerle |
| 2,925,236 | A | | 2/1960 | Cook et al. |
| 3,054,494 | A | | 9/1962 | Stoll |
| 3,163,386 | A | | 12/1964 | Collins |
| 3,214,126 | A | * | 10/1965 | Roos |
| 3,285,553 | A | | 11/1966 | Hexdall |
| 3,425,655 | A | | 2/1969 | Cogdill |
| 3,528,636 | A | | 9/1970 | Schmidt |
| 3,648,626 | A | * | 3/1972 | Schuster |
| 3,718,307 | A | * | 2/1973 | Albanese |
| 3,892,378 | A | | 7/1975 | Lane |
| 4,165,851 | A | | 8/1979 | Bowden, Jr. |
| 4,391,428 | A | | 7/1983 | Grimes |
| 4,703,593 | A | * | 11/1987 | Smolik |
| 4,717,101 | A | | 1/1988 | Harrod |
| 4,957,251 | A | * | 9/1990 | Hubbard |
| 4,967,990 | A | | 11/1990 | Rinderer |
| 5,029,794 | A | | 7/1991 | Wolfe |
| 5,060,892 | A | * | 10/1991 | Dougherty |
| 5,209,444 | A | | 5/1993 | Rinderer |
| 5,346,036 | A | * | 9/1994 | Arisman et al. |
| 5,386,959 | A | * | 2/1995 | Laughlin et al. |
| 5,593,115 | A | * | 1/1997 | Lewis |
| 5,619,263 | A | | 4/1997 | Laughlin |
| 5,934,631 | A | | 8/1999 | Becker et al. |
| 6,068,084 | A | * | 5/2000 | Taormina |
| 6,079,677 | A | | 6/2000 | Daond |

* cited by examiner

*Primary Examiner*—David J. Walczak
*Assistant Examiner*—Khoa Huynh
(74) *Attorney, Agent, or Firm*—Stetina Brunda Garred & Brucker

(57) ABSTRACT

A stub-out bar has a first bar telescopically and slidably receiving a second bar. Holes and slots are formed on the first bar and the second bar, respectively. While attaching a fixture on the stub-out bar, one of the holes is aligned with one slot to allow a fastener to thread through. The first and the second bars each has a bendable tab extending from a front plate thereof. The bendable tabs are positioned at two opposite ends of the stub-out bar such that the stub-out bar can be mounted in different surfaces of joists by simply bending the bendable tabs. The stub-out bar has an open cross-section, in a box-shape. The first and second bars are made of a sufficiently heavy gauge of metal that heavy-duty applications such as bathroom tub and shower fixtures can be supported.

18 Claims, 8 Drawing Sheets

STUB-OUT BAR

FIELD OF THE INVENTION

The invention relates in general to a supporting structure for plumbing pipes, fittings and fixtures.

BACKGROUND OF THE INVENTION

A stub-out bar is installed between spaced joists or studs so that plumbing fixtures can be attached to the bar. Conventional stub-out bars are often not strong enough to hold heavy plumbing fixtures. There is thus a need for a stronger stub-out bar. Further, conventional stub-out bars typically allow fastening of plumbing fixtures on only one surface of the stub-out bar. There is thus a need for a stub-out bar that allows greater flexibility in connecting plumbing fixtures to the stub-out bar. There is also a need for a stub out bar that accommodates the above needs while also accommodating plumbing fixtures that extend inward varying distances from the wall to which the stub-out bar is mounted.

SUMMARY OF THE INVENTION

The invention provides a stub-out bar to support plumbing fixtures, especially for those heavy-duty applications such as bathroom, tub and shower fixtures. The stub-out bar has a nearly closed box shape that gives more rigidity and strength than the typical flat or three-sided structure. The box shape also allows fittings to be attached on any side of the stub-out bar with any orientation. The stub-out bar advantageously includes two bendable tabs at two opposite ends, so that a great flexibility in length for the installation is obtained.

The stub-out bar comprises a first bar and a second bar telescopically engaged with each other. The first bar comprises a front plate, two side plates protruding from two opposite sides of the front plate, and two flanges, protruding from the side plates in a direction parallel to the front plate and spaced from each other. Holes are formed on the front plate and the side plates. The second bar comprises a front plate and two side plates protruding from two opposite sides of the front plate. The front plate and the side plates of the second bar advantageously have slots therein. The first and second bars are sized and shaped so one fits or nests within the other and so they can slide relative to each other. While attaching fittings on the stub-out bar, some of the holes and the slots of each bar are aligned with each other to allow a fastener to thread through both bars. The combination of holes and slots makes it possible to mount a wide variety of devices having different hole center dimensions, and allows great latitude in where devices are mounted. Each of the first and second bars advantageously has a bendable tab extending from one end of each front plate. These bendable tabs are positioned at opposite ends of the stub-out bar.

Both the foregoing general description and the following detailed description are exemplary and explanatory only and are not restrictive of the invention, as claimed.

DESCRIPTION OF THE PREFERRED EMBODIMENTS

Figure 1:
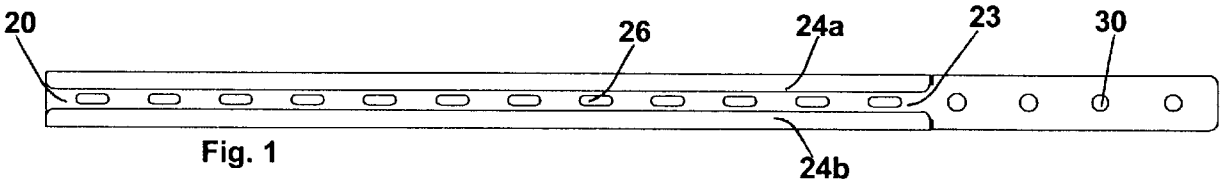
FIG. 1 shows the rear view of a first bar of a stub-out bar of this invention.
Figure 2:
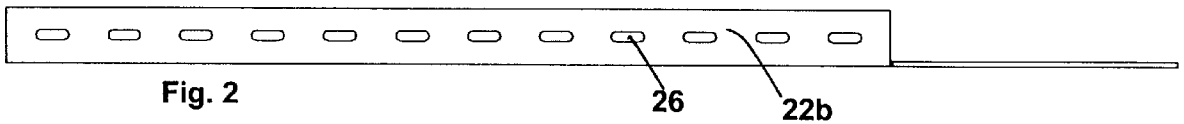
FIG. 2 shows a top view of FIG. 1; with the bottom side being the same.

The invention provides a stub-out 100 (FIG. 12) bar that comprises a first bar 10 and a second bar 12 with one telescopically and slidably engaged in the other. The first bar 10 is exterior of the interior bar 12 in the drawings. FIGS. 1–5 show the rear view, the top/bottom view, the front view, a three dimensional view, and an end view respectively, of a first bar 10. The first bar 10 comprises four sides, that is, a front plate 20, top and bottom plates 22 (22*a*, 22*b*) and the flanges 24 (24*a*, 24*b*).

The use of front, top, bottom, etc. is for convenience and refers to the depiction used in the drawings to illustrate the invention. The front plate 20 is so named because it faces the interior of the room as typically installed and is thus the first or front portion of the bar 12. The top and bottom refer to normal upward and downward orientation shown in the drawings. It is to be understood that these local coordinate systems are for understanding the construction and use of the stub-out bar 100, and are not limiting the actual or intended use of the bar. For example, the stub-out bar 100 could be used in a ceiling in which the top and bottom sides 22*a*, 22*b* becomes a matter of relative orientation which does not affect the construction or use of the stub-out bar 100. As a further example, the front plate 20 could be installed facing away from the interior of the room.

The top and bottom plates 22 protrude from two opposite edges of the front plate 20. The flange 24 has two portions 24*a*, 24*b* protruding from the top and bottom plates 22*a* and 22*b* with an open space 23 in the middle. Preferably, the front plate 20 and the flange 24 are parallel to each other, while the top and bottom plates 22*a* and 22*b* are two opposite sides parallel to each other. In most application, the top and bottom plates 22*a* and 22*b* are perpendicular to the front plate 20 and 24. Other orientations are possible, such as having the side plates 22 angled toward or away from each other, or having flanges 24*a*, 24*b* incline toward or away from the back plate 20.

The four sides 20, 22 and 24 advantageously construct a nearly-closed, channel shape that advantageously, but not necessarily, has a quadrilateral, preferably rectangular, and more preferably a square, cross-section. That nearly-closed shape gives the first bar 10 more rigidity and strength than a conventional flat bar or three-side bracket. On the front plate 20 and top and bottom plates 22, holes such as slotted holes 26 are formed to allow fastening members 27 such as screws, bolts, or the like to thread through. The open space 23 between flanges 24*a*, 24*b* is preferably as small as possible in order to increase the stiffness and strength of the bracket, and that can result in the edges of flanges 24*a*, 24*b* abutting or nearly abutting each other. But it is also advantageous to size the space 23 to allow a longer fastening member to thread through, with the space 23 preferably being situated so the edges of the flanges 24*a*, 24*b* engage the threads of the fastener. Thus, the slot or space 23 is advantageously not larger than the diameter of a threaded fastener of the type normally used with the stub-out bar 100 of a particular size. The space 23 is preferably smaller in order to stiffen the stub-out bar 100. The space 23 could be larger, but it is less preferable.

The first bar 10 further preferably, but optionally, comprises a bendable tab 28 extending from one end and on the same surface as the front plate 20. The bendable tab 28 may extend outward beyond the sides 20, 22 and flanges 24 and has holes 30 formed thereon to allow fastening members to thread through. Preferably, the first bar 10 is made of sufficiently heavy gauge metal (e.g., steel, clad metal, aluminum) to securely support plumbing fixtures such as bathroom tub and shower fixtures. The thickness can be varied for the intended use.

FIGS. 6–10 show the rear view, the top/bottom view, the front view, a three-dimensional view, and an end view, respectively, of second bar 12. The second bar 12 is similar to first bar 10, and comprises three sides, namely, a front plate 40 and top and bottom plates 42 (42*a*, 42*b*). The top and bottom plates 42 protrude from two opposite edges of the front plate 40. Preferably, the top and bottom plates 42*a* and 42*b* are two opposite sides parallel to each other. In most applications, the top and bottom plates 42*a* and 42*b* are perpendicular to the front plate 40. On the front plate 40 and the top and bottom plates 42, holes such as slots 46 and 44 are formed to allow fastening members such as screws, bolts, or the like to extend through the slots. In one preferred embodiment of the invention, the slots 46 on the front plate 40 are longer than the slots 44 on the side plates 42, and preferably, but optionally, extend substantially the entire length of the front plate 40. It is appreciated that the dimensions of the holes 26 and the slots 44 and 46 can be modified according to specific requirements to obtain an optimal effect for supporting specific appliances.

The second bar 12 further advantageously, but optionally, comprises a bendable tab 48 extending from one end and on the same surface as the front plate 40. The bendable tab 48 extends from the front plate 40 and may extend beyond the top and bottom plates 42, and has holes 50 formed thereon to allow fastening members to pass through. Like the first bar 10, the second bar 12 is made of sufficiently heavy gauge metal to securely support heavy-duty fixtures such as bathroom tub and shower fixtures, but the material and thickness of the first and second bars 10, 12 can be varied to support the fixtures intended to be fastened to the stub-out bar during use.

Figure 4:
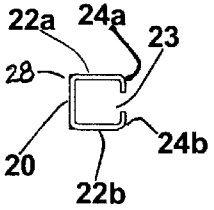
FIG. 4 shows an end view of FIG. 1.
Figure 9:
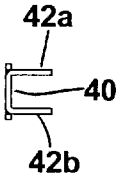
FIG. 9 shows an end view of FIG. 1.
Figure 10:
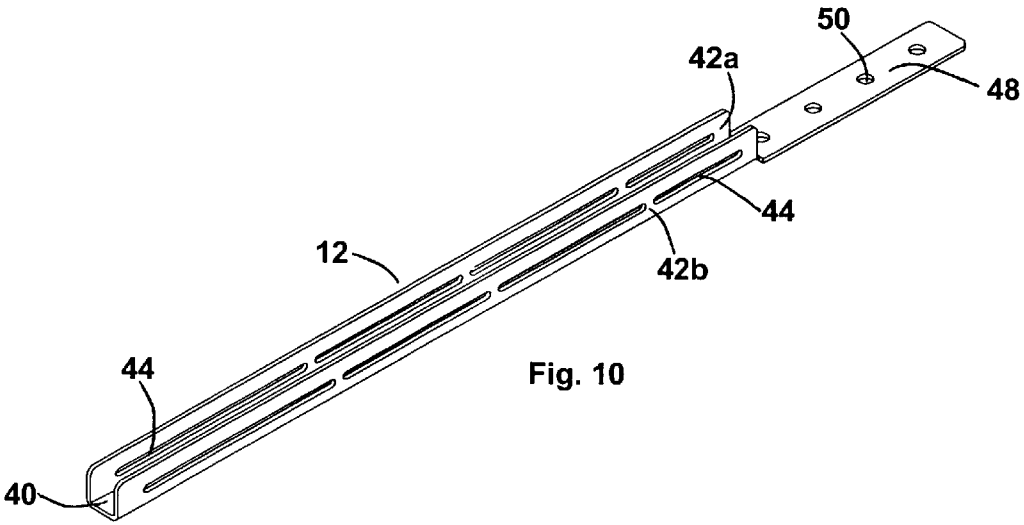
FIG. 10 shows a perspective view of FIG. 1.
Figure 11:
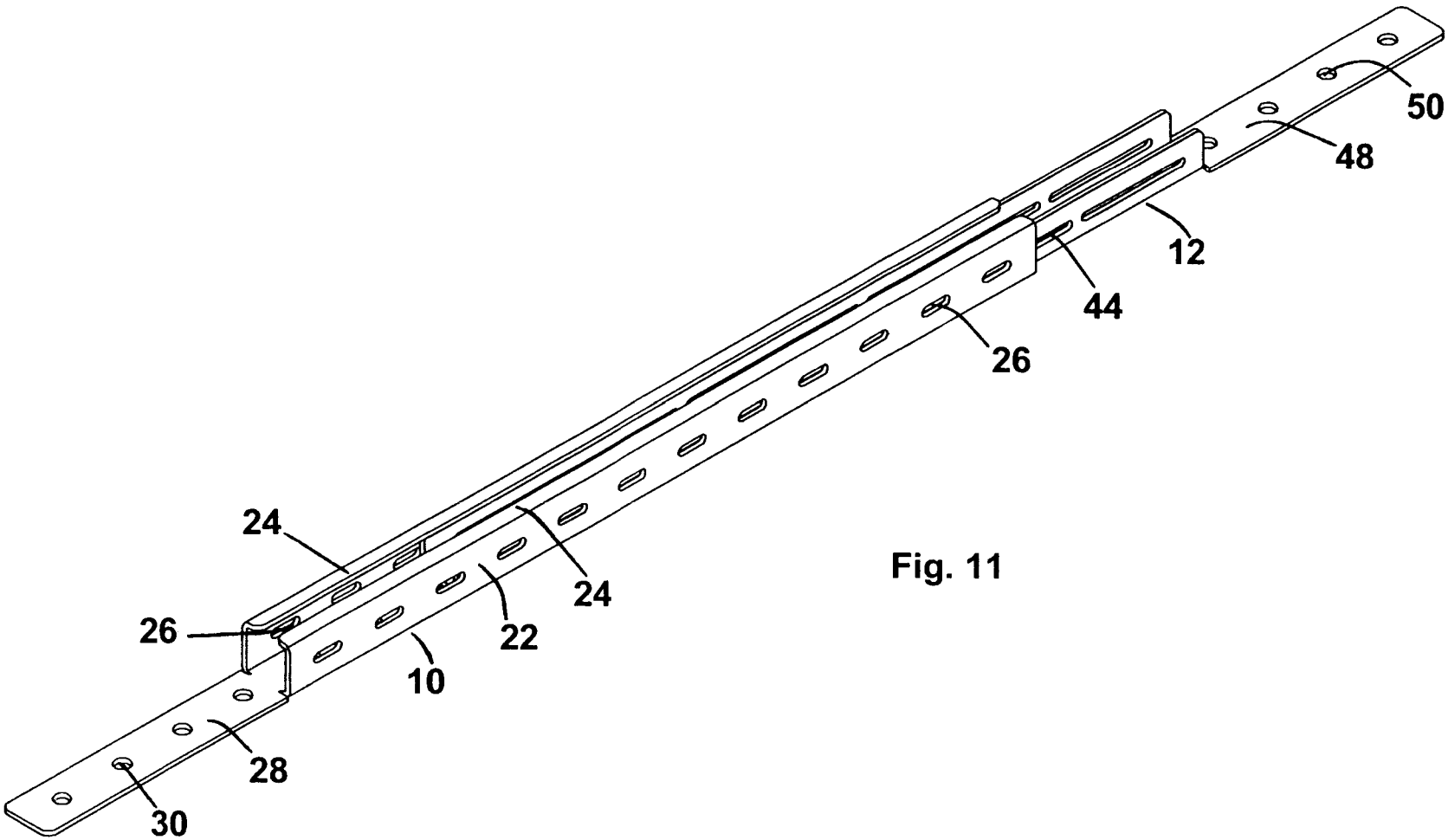
FIG. 11 shows the structure of the assembled stub-out bar.

As shown in FIG. 11, the stub-out bar 100 comprises the second bar 12 telescopically and slidably engaged in the first bar 10. The first and second bars 10,12 are sized and shaped to allow the bars to be nested, and slide relative to each other. As seen in FIGS. 4 and 9, the edge of tab 48 may extend beyond the sides 22, 42 and therefore may hit the sides to limit relative motion of bars 10, 12. The bendable tab 28 of the first bar 10 is positioned in the opposite end to the bendable tab 48 of the second bar 12. In this manner, one can mount this stub-out bar between two spaced studs or joints 14 with a great flexibility in length, and move the bars 10, 12 relative to each other to adjust the length.

Figure 12:
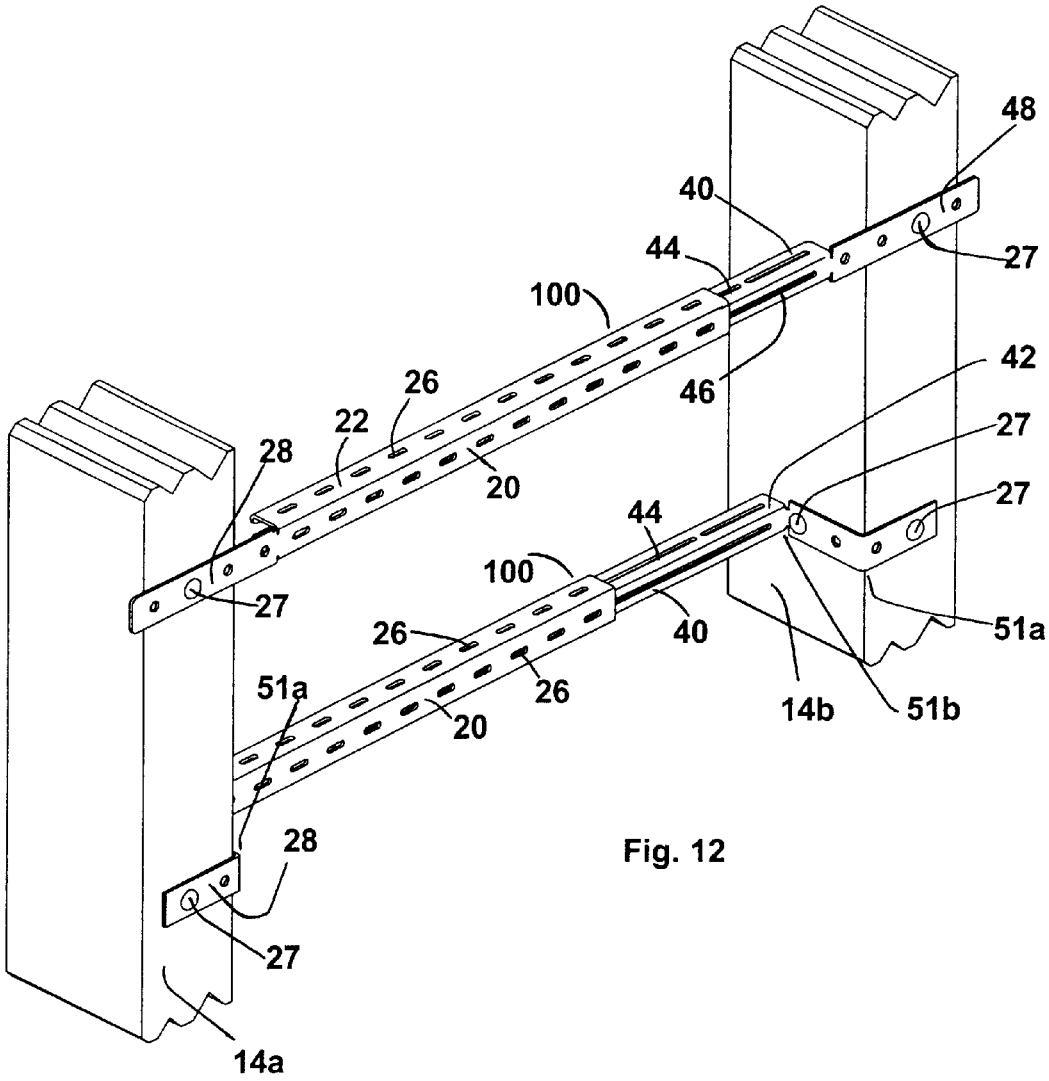
FIG. 12 shows the assembled stub-out bar mounted between a pair of studs.

Further, as shown in FIG. 12, the stub-out bar 100 is mounted between two studs 14*a* and 14*b* in different ways. The undeformed tabs 28 and 48 can be mounted on surfaces of the studs 14*a* and 14*b* facing the interior of a room. Alternatively, the bendable tabs 28 and 48 can be bent, preferably twice, to place the holes 26, 44, 46 recessed from the room-facing surface of the studs 14, and optionally fastened to inner surfaces of the studs 14*a* and 14*b*. Therefore, if the fixtures to be fastened to the stub-out bar can only be mounted to a bar 100 that is recessed, and between two joists or studs, one can easily bend the bendable tabs 28 and 48 at bends 51, and fit the stub-out bar 100 between the studs 14 without occupying any additional space. The telescoping, sliding fit of bars 10, 12 allow the bar 100 adjusted to accommodate the spacing between studs 14.

Figure 13:
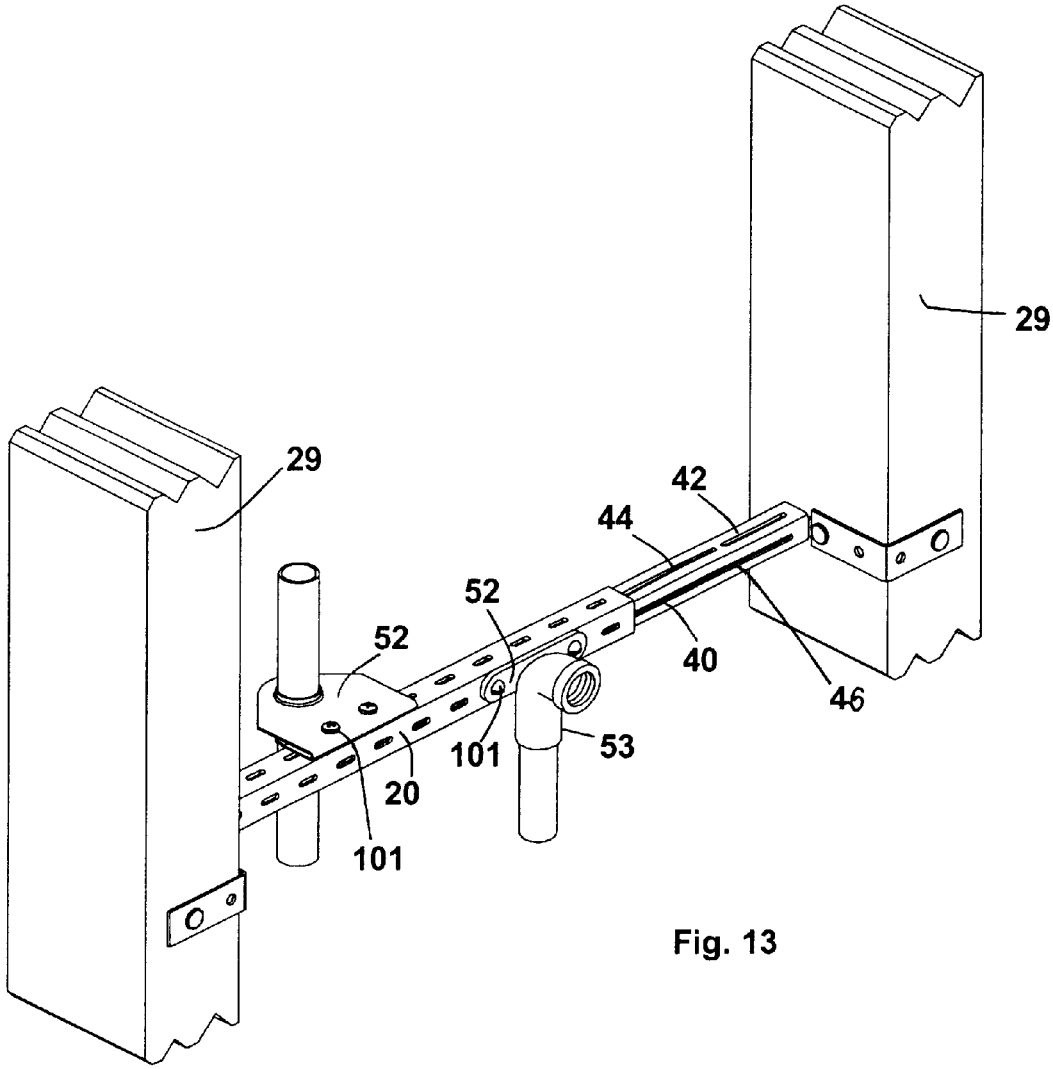
FIG. 13 shows the attachments of fittings on the assembled stub-out bar.

The location of the bend or bends 51 are selected to accommodate the desired amount of recess from the surfaces of studs 14 facing the interior of the room, and are preferably provided at periodic intervals. The bend or bends 51 are preferably used to form two right angle bends 51*a*, 51*b* as shown in FIGS. 12, 13. That arrangement allows fasteners 27 to fasten tabs 28, 48 to two surfaces of the studs or structural supports 14. But depending on the amount of offset or recess needed, and depending on the length of tabs 28, 48, the tabs 28, 48 could be each bent only once and fastened only to the sides of studs 14 that face each other.

The bends 51 can be formed on site with a pair of pliers, or a hammer and any piece of wood with a square comer. If desired, notches, slots, creases or other weakened sections can be formed in tabs 28, 48 to make it easier to bend the tabs along the weakened section or at the weakened location.

Figure 14:
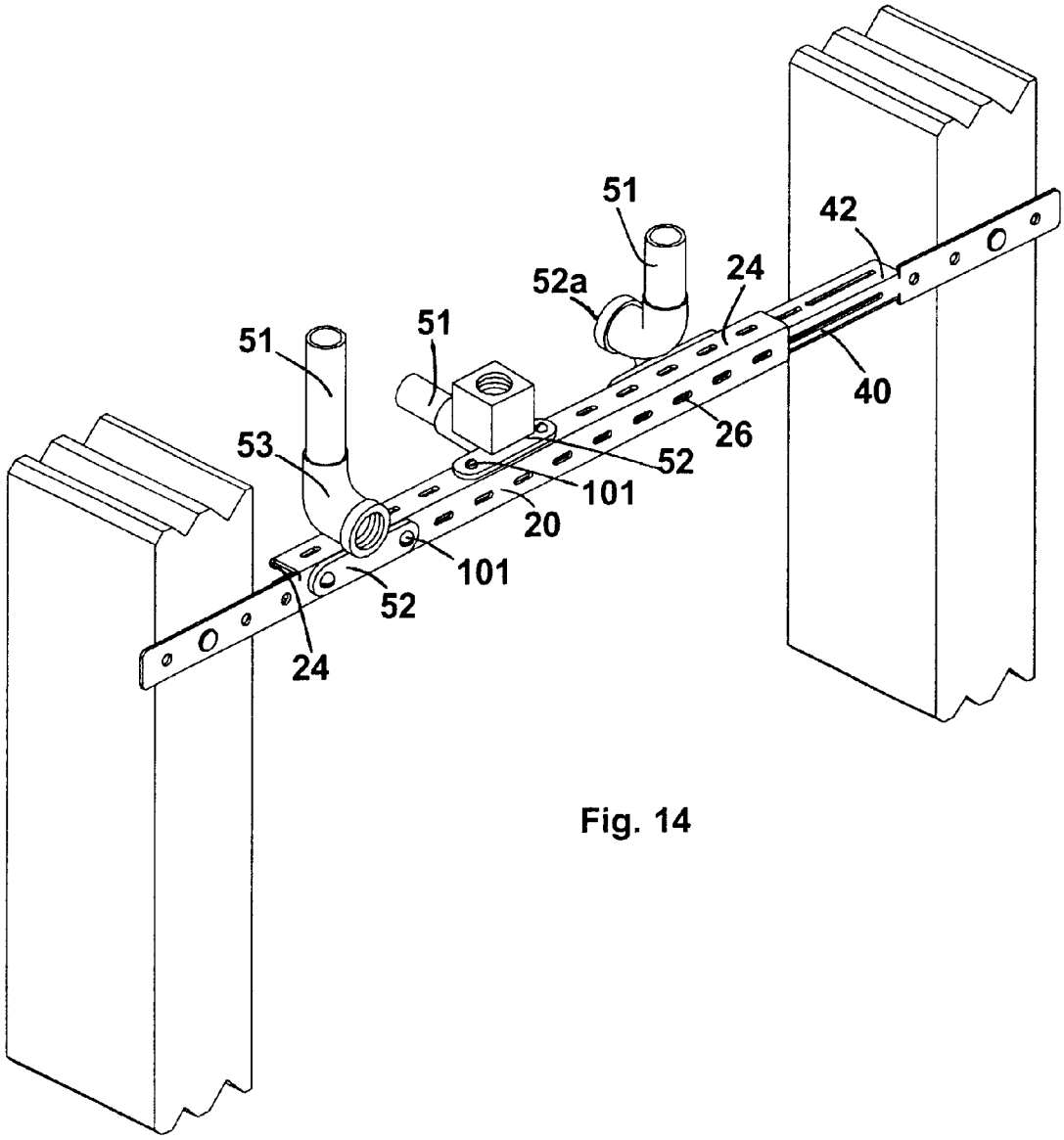
FIG. 14 shows another example for mounting fittings on the assembled stub-out bar.
Figure 15:
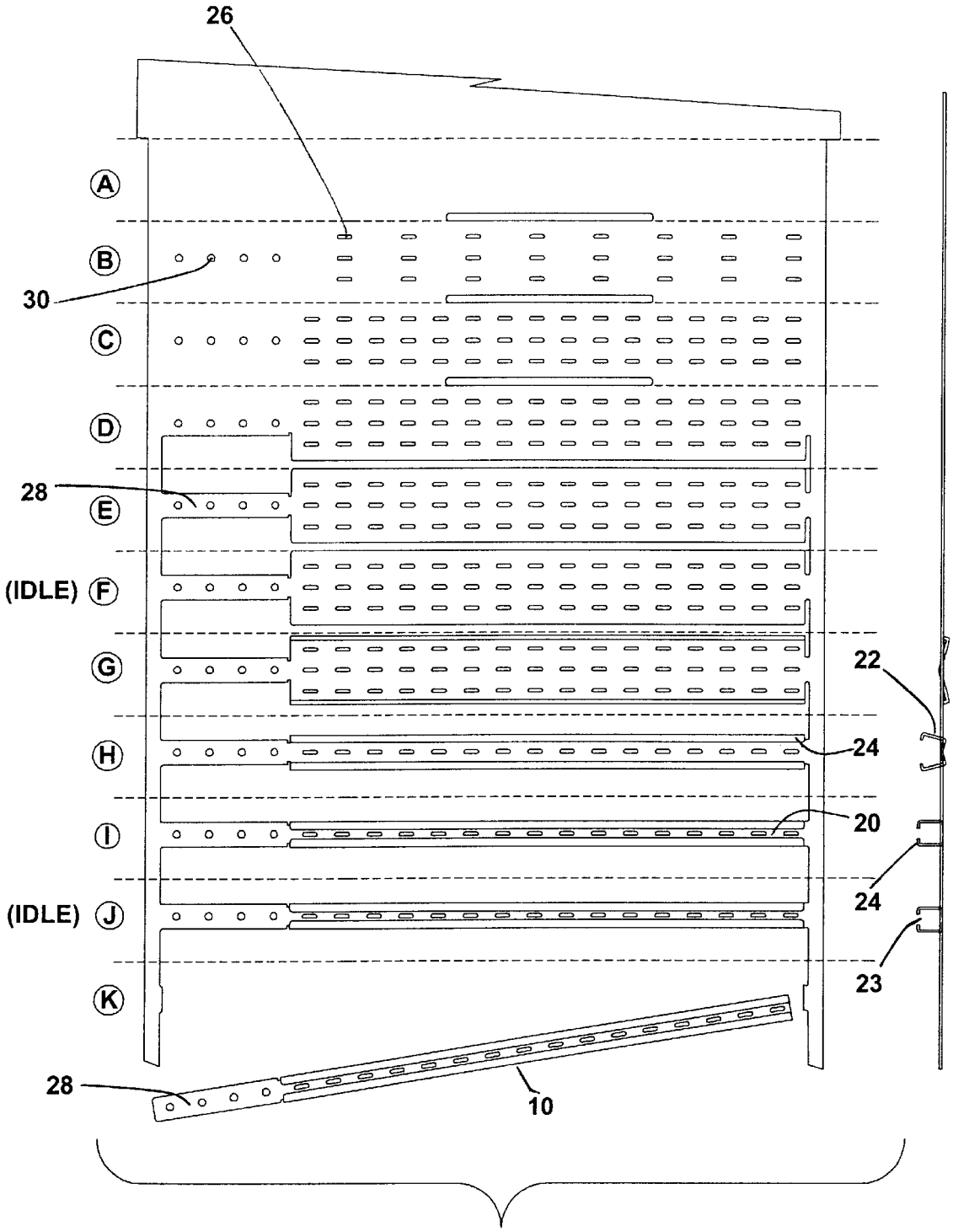
FIGS. 15*a–k* show a sequence for forming the stub-out bar sections from a strip of material.

FIGS. 13 and 14 show the application for attaching plumbing fixtures on the stub-out bar 100. A bracket 52 of various shapes can be used to fasten pipes 51 to the bar 100. The shape of the bracket 52 may depend on whether the bracket connects to the pipe 51 or a fitting such as an elbow that is connected to the pipe. The bracket 52 has one portion adapted to connect to or hold the pipe and a second portion adapted to connect to the stub-out bar 100, preferably using one or more of holes 26, 44, 46.

In the Figures, an elbow 53 and a bracket 52 are attached to the stub-out bar 100. The elbow 53 is connected to holes 24, 44, 46 of the first bar 10 and second bar 12. The elbow 53 and bracket 52 can be connected on the stub-out bar 100 in various ways, including wire, snap-lock fasteners, or threaded fasteners 101 such as screws or bolts and nuts. While attaching these brackets 52, some of the holes 44, 46 of the second bar 12 are preferably aligned with at least one hole 26 of the first bar 10, although bracket 52 may be attached nearer to one end of bar 100 such that only one of bars 10, 12 is engaged.

Figure 3:
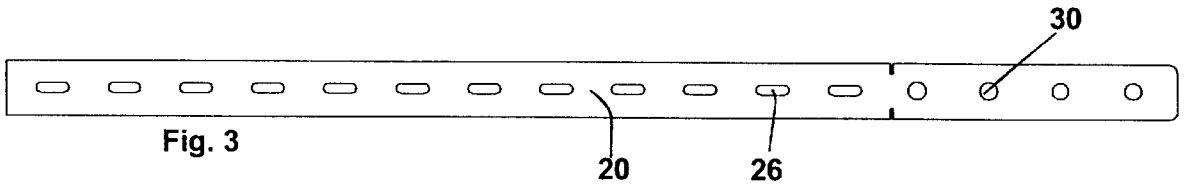
FIG. 3 shows a front view of FIG. 1.

The positions for these configuration and brackets 52 can be rearranged as needed. For example, in FIG. 13, the elbow 53 is attached to the front side 20 or 40 of at least one of the first and seconds bars 10, 12. The bracket 52 attached to pipe 51 is fastened to at least one of the sides 22 and 42. As shown in FIG. 14, the two elbows 53 can be fastened to front plate 20 or to the opposing flanges 24. The flanges 24 can be spaced so that a threaded fastener 101 engages opposing edges of flanges 24*a*, 24*b* (FIG. 3).

Figure 5:
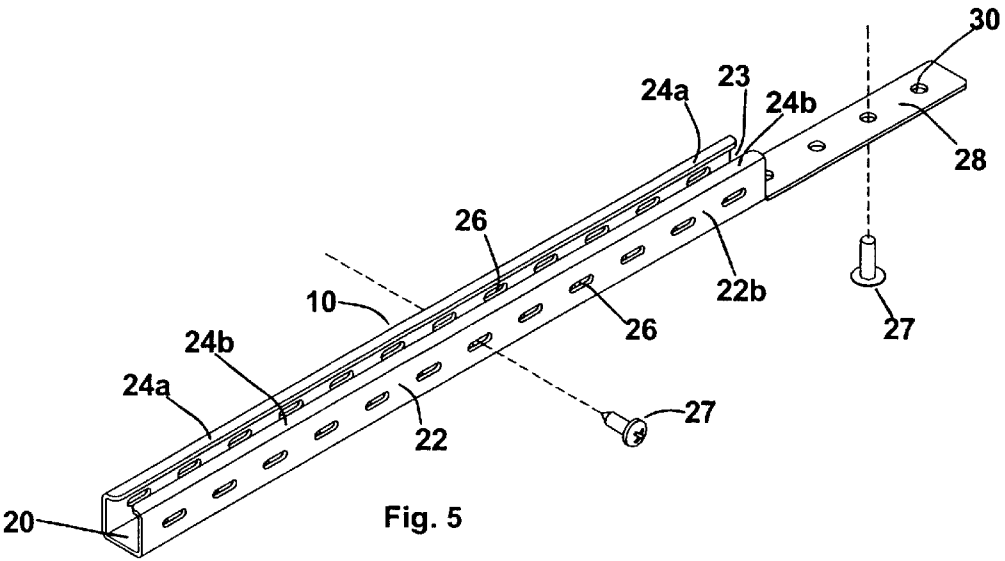
FIG. 5 shows a perspective view of FIG. 1.
Figure 6:
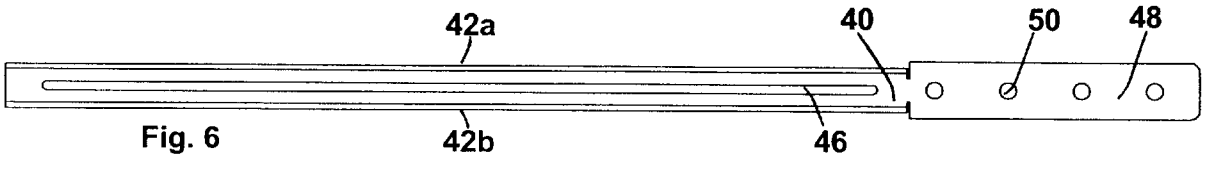
FIG. 6 shows the rear view of a second bar of a stub-out bar of this invention.
Figure 7:
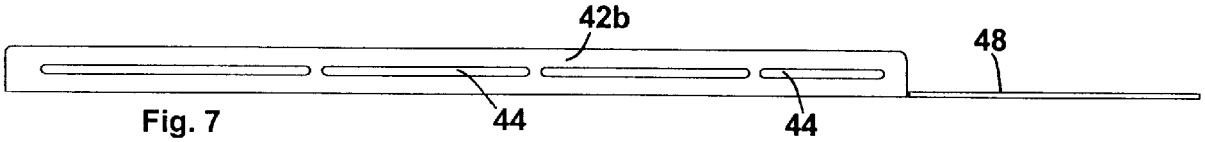
FIG. 7 shows a top view of FIG. 1; with the bottom side being the same.
Figure 8:
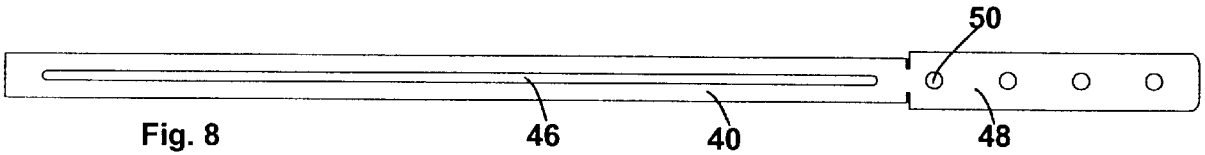
FIG. 8 shows a front view of FIG. 1.

Alternately, the fastener 101 can pass through the space 23 between the flanges and through slot 46 and a hole 26 in the back plates 40 and 20, respectively, where the fastener can either engage the edges of the holes, or extend through the holes to engage a nut, clothespin, snap ring or other device to prevent removal of the fastener 101. Thus, as shown in FIGS. 5 and 6, the fixtures such as pipe clips, elbow, fittings may be mounted to any sides of the stub-out bar 100 securely in any orientation.

The combination of the holes 26 of the first bar 10 and the slots 44 and 46 of the second bar 12 provides a wide variety of spacings for plumbing fixtures having different hole center dimensions. Because elongated openings or slots may result in less rigidity than smaller or circular openings, it is desirable to have the larger slots on the inner bar 12. But it is contemplated that the outer bar 10 could have the larger openings and/or slots with the inner bar 12 having smaller openings, slots or holes.

These various combinations of holes of various sizes and shapes and locations also allows great latitude in where devices are mounted along the stub-out bar 100, as a bracket 52 could be mounted to either or both of the sides 22*a*, 22*b*, 42*a*, 42*b* of the bars 10, 12, as well as being mounted to the front 20 or back 24 (via slot 23) of the bracket, or combinations of the above (e.g., L shaped bracket).

Referring to FIGS. 13–14, the brackets 52 can comprise portions of planar strips of material, including polymers and plastics, but preferably metal, with an opening to accommodate passage of pipe 51, and with holes to accommodate passage of fasteners 101. Alternatively, the brackets 52 could connect to a side of the bar 100 that is at angle to the plumbing fitting or pipe, usually at a right angle. Various configurations are possible.

The brackets 52 could have the fastener 101 built in, in which case the fasteners could take the form of members extending through the holes 26, 44, 46 or space 23 to be engaged by a device that prevents removal. Alternatively, the fasteners 101 could comprise L-shaped legs that are inserted through one or more holes 26, 44 46 or space 23 and then slid to one side to engage the walls adjacent to or defining the hole through which the L-shaped leg extends, with a threaded fastener holding the bracket in place. This forms a type of sliding bayonet lock. Other fastening mechanisms could be used.

The brackets 52 can also comprise elongated strips fastened to, or formed integrally with, a plumbing fitting such as an elbow, T-joint, etc. The brackets 52 preferably have at least two holes spaced to accommodate the spacing of at least some of the holes 26, 44, 46. The holes 26, 44,46 are preferably periodically spaced and sized to allow passage of, or engagement with, fasteners 101. Depending on the use of the stub-out bar 100, the size and strength of fasteners 101 will also usually vary. It is believed useful to have holes 26, 44, 46 comprise elongated slots, with holes on the inner bar 12 aligning with holes on the outer bar 10 so as to locate the holes at the spacing intervals corresponding to the location of fasteners 101 used with brackets 52.

In the above embodiments, the inner and outer, or second and first bars 12, 10, have open cross-sections. The cross-section of the first bar 10 is preferably square or rectangular but the ends of the flanges 24*a*, 24*b* are not joined to form a closed section. Second bar 12, has three sides, preferably in a U-shape, and sized and configured to telescopically slide or nest within the cross-section of the first bar. The open cross-section allows the bars 10, 12 to be formed from a flat sheet of material, and preferably from an elongated strip of material such as metal. A preferred sequence for forming first bar 10 is illustrated in FIGS. 15*a–k*, and is described primarily for bar 10, as the sequence can be substantially the same for second bar 12 except for omitting the formation of flanges 24 when those flanges are not present on bar 12. The holes 26, 30, 50, 44, 46 can be punched progressively in the flat strip, prior to forming the sides 22, 42, and flanges 24. As appropriate, the flanges 24 can be formed, preferably prior to forming the sides 22, 42. The sides 22, 42 are then bent, preferably perpendicular to the intervening front plate 20 or 40. Flanges could optionally be formed on both bars 10, 12, but are preferably only on bar 10.

It is believed helpful to have the width of end tab 48 wider than the width of front plate 40 between sides 42*a*, 42*b* on the bar 12. Short slits or cuts in the edges at the transition between the sides 22, 42 and end tabs 28, 48 on bars 12, 10 make it easier to bend the sides into position. Separate punches, dies and bending tools are preferably used for bars 10 and 12, and the set of punches, dies and bending tools for each of bars 10, 12 may be combined into separate progressive tools for each of the bars 10, 12 to accomplish the fabrication of FIG. 15.

There is thus advantageously provided a method of forming the stub-out bar 100. It is believed also suitable to use extruded tubing with a closed section, and to cut the various holes as and where needed, including a slot 23 that does not extend the length of sides 22, 42, to form a stronger bar 10, 12. But the cost of doing so is believed higher than punching and bending flat strips to form an open section. The open section of bar 10 could be closed by welding slot 23 to form a closed section of increased strength and stiffness at various locations along the length of the bar 10. But added cost of doing so is believed unnecessary.

Figure 16:
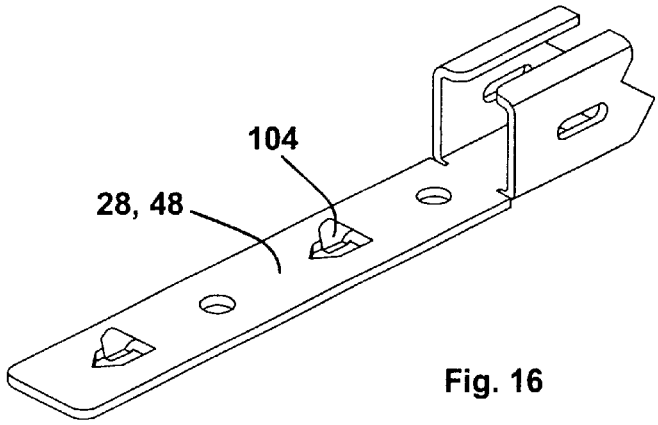
FIG. 16 shows an alternate means for attaching the stub-out bar to a stud or joist.

A further embodiment of this invention replaces at least some, and preferably all of the holes 30, 50 in the end tabs 28, 48 with bendable projections 104 (FIG. 16). The bendable projections are triangular or elongated with a point, and preferably bent during formation by a punching operation. By hitting the bent portion with a hammer the projection can be embedded in the support structure so that nails, screws, etc. are not needed to fasten it to the structure.

In the above description, the slots 44, 46 in the bar 12 are more elongated than the holes 26 in the outer bar 10. The more elongated slots could be formed in the outer bar 10. But by placing the smaller slots or holes in outer bar 10, that bar remains stiffer and stronger and thus provides a sturdier stub-out bar 100 as the outer bar 10 encloses and supports the inner, telescoping bar 12. The holes 26 in each side 20, 22 preferably overlap with the holes 44, 46 in the sides 40, 42 of the second bar 12 along a substantial length of the overlapping, telescoped portion. A substantial length comprises over at least half the overlapping portion, and preferably over 90% of the overlapping portion, and ideally for as much of the overlapping portion as possible in order to allow the maximum range of positions through which to insert fasteners 27.

Figure 17:
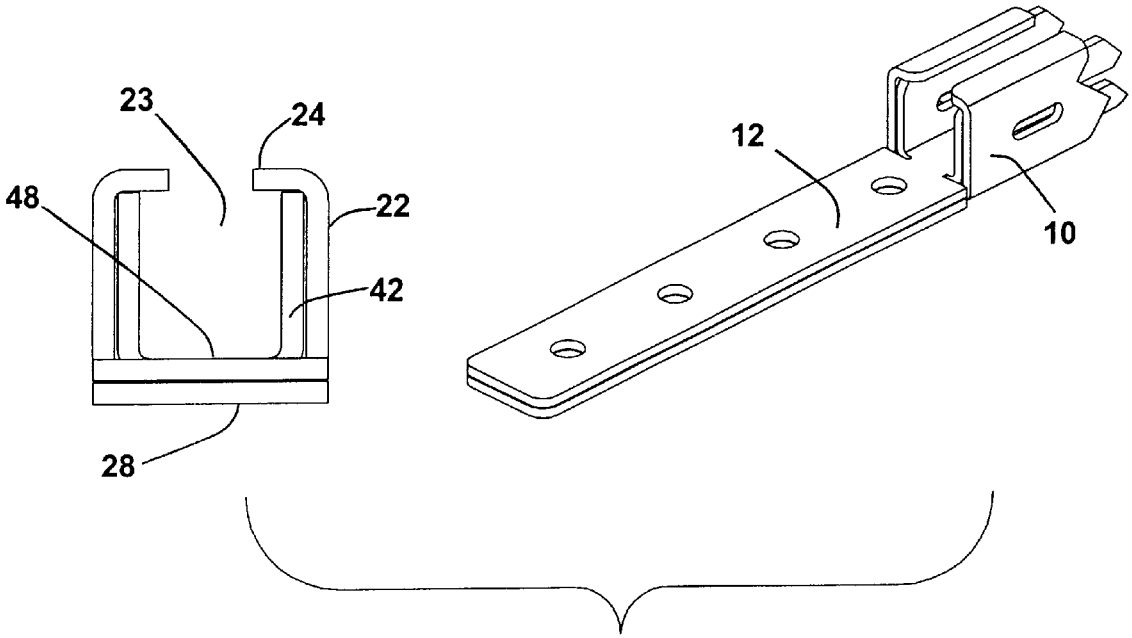
FIG. 17 shows an alternate arrangement for assembling the stub-out bar sections, as for shipping.

During use the tabs 28, 48 extend from opposing ends of stub-out bar 100 so the tabs can be fastened to different structures or studs. But for shipping it may be desirable to nest the inner, second bar 12 inside the first out bar 10 with the tabs abutting as shown in FIG. 17. This provides a shorter assembly for shipping, and decreases the chance of damage to adjacent articles by providing fewer exposed corners.

Other embodiments of the invention will appear to those skilled in the art from consideration of the specification and practice of the invention disclosed herein. It is intended that the specification and examples be considered as exemplary only, with a true scope and spirit of the invention being indicated by the following claims. Thus, the above description is given by way of example, and not limitation. Given the above disclosure, one skilled in the art could devise variations that are within the scope and spirit of the invention, including various ways of locating the slots, holes and various sized openings in the bars 10, 12. For convenience, the term aperture will be used to refer to any of these various slots, holes or openings.

Further, the various features of this invention can be used alone, or in varying combinations with each other, and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A stub-out bar for holding plumbing fittings in position between structural supports, comprising:

a first bar, having:

a first front plate defining a plurality of apertures, two side plates protruding from two opposite sides of the front plate and each having a plurality of apertures, and two flanges, protruding from the side plates toward each other but ending spaced apart from each other to define an elongated opening; and a second bar, telescopically and slidably engaged in the first bar, the second bar having a second front plate defining at least one aperture therein; and two side plates protruding from two opposite sides of the front plate and each having a plurality of apertures, the apertures in the first and second bars being sized to receive fasteners sized to hold plumbing fittings.

2. The stub-out bar according to claim 1, wherein each of the first and the second bars further comprises a tab extending from one end of each bar.

3. The stub-out bar according to claim 2, wherein each of the tabs extends from the front plate of the associated bar and contains at least one aperture.

4. The stub-out bar according to claim 2, wherein the tabs are bendable to offset the stub-out bar, and wherein the tabs extend from the front plates of the first and the second bars in two opposite directions.

5. A stub-out bar assembly, comprising:

a first bar having an open cross-section formed by at least three sides with a plurality of apertures in each side and a first bendable tab at one end of the first bar the at least three sides including a front plate with two side plates protruding from two opposite edges of the front plate and a flange protruding from each of the side plates toward on another, but not abutting one another;

a second bar, telescopically and slidably received within the first bar, the second bar having an open cross-section formed by at least three sides with a plurality of apertures in each side and located to align with the apertures in the first bar, and a second bendable tab at one end of the second bar; wherein the first and the second bendable tabs are positioned at two opposite ends of the stub-out bar and the apertures in the first and second bars align along at least a substantial length of the telescoped portion of the bars to allow fasteners to pass through the apertures.

6. The stub-out bar assembly according to claim 5, wherein the apertures of the second bar include a plurality of slots having a length greater than a length of the apertures in the first bar.

7. The stub-out bar assembly according to claim 5, further comprising a bracket or fitting connected to at least one of the first and second bars by at least one fastener extending through at least one of the apertures in the bars, either the bracket or fitting having an opening configured to hold a pipe.

8. The stub-out bar assembly according to claim 7, further comprising a pipe connected to the opening in the bracket or fitting.

9. The stub-out bar assembly according to claim 7, further comprising a pipe connected to at least one of the first and second bars by at least one fastener extending through at least one aperture in at least one bar.

10. A plumbing fixture assembly, comprising:

a stub-out bar, having:

a pair of telescoped bars each having at least three sides with a plurality of aligned apertures in each side, with one telescoped bar slidably received within the other and a bendable tab extending from one end of each of the telescoped bars in two opposite directions, an outer one of the pair of telescoped bars including two flanges each extending from a different one of the at least three sides and toward one another to form an elongated opening between the flanges; and a plumbing pipe fastened to at least one of the telescoped bars by at least one fastener extending through at least one of the apertures.

11. The plumbing fixture assembly of claim 10 further comprising a bracket or fitting interposed between the telescoped bars and the pipe.

12. The plumbing fixture assembly of claim 11 wherein the bracket has two apertures spaced to align with the apertures of the telescoped bars, and where the assembly further includes two fasteners, one extending through each of the two spaced apertures.

13. A stub-out bar, comprising:

a first bar having an open box shape cross-section of four sides and a plurality of apertures in at least three sides thereon wherein the four sides of the first bar include a front, two opposing sides extending from opposing edges of the front, and two flanges extending toward each other from edges of the opposing sides, the flanges having distal edges almost abutting each other;

a second bar having a U-shaped cross-section of at least three sides and telescopically received within the first cross-section and having a plurality of apertures in each of the at least three sides wherein the first and second bars are slidable relative to each other to adjust the distance between ends of the bars and to align apertures in the sides of the respective bars, and a tab extending from each bar along a length of each bar and in a common plane.

14. The stub-out bar of claim 13, wherein at least some of the apertures in the second bar comprise slots extending along a longitudinal length of the bar.

15. The stub-out bar of claim 13, wherein the front plate of the first bar has apertures with dimensions selected to allow passage of a threaded fastener and wherein the distal edges of the flanges are spaced apart sufficiently to threadingly engage said fastener.

16. The stub-out bar of claim 13, wherein the distal edges of the flanges are spaced apart a distance corresponding to the size of the apertures in the front of at least one bar.

17. The stub-out bar of claim 13, further comprising a bracket fastened to the front of the stub-out bar, the bracket configured to connect to a plumbing pipe or fitting.

18. The stub-out bar of claim 13, further comprising a bracket fastened to one of the sides of the stub-out bar, the bracket configured to connect to a plumbing pipe or fitting.

* * * * *